US011638671B2

(12) United States Patent
Trammell

(10) Patent No.: US 11,638,671 B2
(45) Date of Patent: May 2, 2023

(54) MYCELIUM COMPOSITE BURIAL CONTAINER

(71) Applicant: Jennifer Trammell, Brooklyn, NY (US)

(72) Inventor: Jennifer Trammell, Brooklyn, NY (US)

( * ) Notice: Subject to any disclaimer, the term of this patent is extended or adjusted under 35 U.S.C. 154(b) by 0 days.

(21) Appl. No.: 17/472,531

(22) Filed: Sep. 10, 2021

(65) Prior Publication Data

US 2023/0080744 A1 Mar. 16, 2023

(51) Int. Cl.
*A61G 17/007* (2006.01)

(52) U.S. Cl.
CPC ..... *A61G 17/007* (2013.01)

(58) Field of Classification Search
CPC ..... A61G 17/007; A61G 17/04; A61G 17/02; A61G 17/041; A61G 19/00; A61G 2203/90
USPC ..... 27/2, 14, 27
See application file for complete search history.

(56) References Cited

U.S. PATENT DOCUMENTS 582,239 A * 5/1897 Snypp ..... B25G 1/10 16/436
4,146,948 A * 4/1979 Royce ..... A61G 17/007 27/5
7,213,312 B2 * 5/2007 Foroni ..... A61P 29/00 220/759
8,112,851 B1 * 2/2012 Hughes ..... A61G 17/041 27/27
8,955,205 B2 * 2/2015 Beliveau ..... A61G 17/00 27/11
9,889,057 B1 * 2/2018 Womack ..... A61G 17/041
10,350,126 B1 * 7/2019 Wessel ..... A61G 17/0076
10,596,055 B1 * 3/2020 Fernandez ..... A61G 17/0136
2008/0034562 A1 * 2/2008 Wensley ..... A61G 17/02 27/3
2010/0299895 A1 * 12/2010 Burlage ..... A61G 17/04 27/14
2012/0260476 A1 * 10/2012 Burnside ..... A61G 17/007 27/16
2012/0266423 A1 * 10/2012 Rojdev ..... A61G 17/0407 27/14
2013/0036583 A1 * 2/2013 Skov ..... A61G 17/004 27/14

(Continued)

FOREIGN PATENT DOCUMENTS

AU 2011224090 A1 * 4/2013
DE 29921202 U1 * 2/2000 ..... A61G 17/00
GB 2558953 A * 7/2018 ..... A22B 7/008

*Primary Examiner* — William L Miller
(74) *Attorney, Agent, or Firm* — Grant Attorneys at Law; Kristin Grant

(57) ABSTRACT

A container for holding the deceased or their remains having an outer surface, a lid, an opening, and one or more pegs. The outer surface made at least in part of mycelium composite and featuring a plurality of equally spaced apart grooves on at least a majority of the outer surface. The lid made at least in part of mycelium composite, wherein the lid is configured to completely seal the opening. The one or more pegs made at least in part of mycelium composite, each peg having a first end and a second end distal from the first end, the first end configured for insertion into any of the plurality of grooves, the second end including of a decorative element.

5 Claims, 4 Drawing Sheets

(56) References Cited

U.S. PATENT DOCUMENTS

| | | | | |
|---|---|---|---|---|
| 2016/0228318 | A1* | 8/2016 | Hoijng | A61G 17/0407 |
| 2020/0206057 | A1* | 7/2020 | Wainman | A61G 17/042 |

* cited by examiner

MYCELIUM COMPOSITE BURIAL CONTAINER

BACKGROUND

Field of Invention

The present invention relates generally to containers for holding the deceased or their remains, and more specifically to a mycelium composite container for use in green or natural burials featuring a peg and groove decorative system on its outer surface.

Related Art

Despite the growing trend toward green burials, options for green burials are limited. A green burial is defined as a means for caring for the dead with minimal environmental impact. Green burials aid in the conservation of natural resources, reduction of carbon emissions, protection of worker health, and the restoration and/or preservation of habitat. Green burials use containers to hold the deceased that can be broken down by bacteria and living organisms in the soil. Biodegradable containers commonly used for green burials include shrouds, cardboard containers, woven fiber containers, and certain wood coffins or caskets. More recently, mycelium containers have also been used.

There is concern that the use of shrouds and reed baskets is disrespectful to the deceased. Reed baskets sag as a result of the weight of the body and a body wrapped in a shroud is very difficult to carry. What is needed is a solid structure that can hold the body providing the deceased with a respectful ceremonial burial.

Mycelium is the vegetative part of a fungus and is an essential part of the life support system for the fungus. Mycelium is composed of fine thread-like filaments of tissue called hyphae. These threads naturally extend into the soil, plant matter, wood, and other materials, excreting enzymes to break down the substrate around them. Mycelium can additionally be utilized in soil pollutant remediation and help regenerate healthy soil bacteria. When used as a burial container, it provides a stable structure for carrying the body and aids in fast decomposition of the body.

In order to adhere to the ethical, environmental, and legal considerations for use in a green burial, interment containers cannot incorporate any materials that contain toxins and they must be biodegradable. As such, green burial containers tend to be plain in design. The present invention discloses a mycelium composite container for use in green and natural burials with a mycelium composite peg and groove decorative system on its outer surface allowing for the outside of the container to feature customizable designs.

SUMMARY OF INVENTION

It is to be understood that the phraseology and terminology employed herein are for the purpose of the description and should not be regarded as limiting.

The present invention is directed to a container for use in green or natural burials having an outer surface, a lid, and opening, and one or more pegs. The outer surface made at least in part of mycelium composite and featuring a plurality of equally spaced apart grooves on at least a majority of the outer surface. The lid made at least in part of mycelium composite, wherein the lid is configured to completely seal the opening. The one or more pegs made at least in part of mycelium composite, each peg having a first end and a second end distal from the first end, the first end configured for insertion into any of the plurality of grooves, the second end including of a decorative element.

These and other features of the present invention will become readily apparent upon further review of the specification and drawings.

BRIEF DESCRIPTION OF THE DRAWINGS

Embodiments of the present invention will be described by way of example only, and not limitation, with reference to the accompanying drawings. The drawings are not necessarily drawn to scale and whenever possible, the same or like reference numbers are used throughout the drawings to refer to the same or like parts.

DETAILED DESCRIPTION

Figure 1:
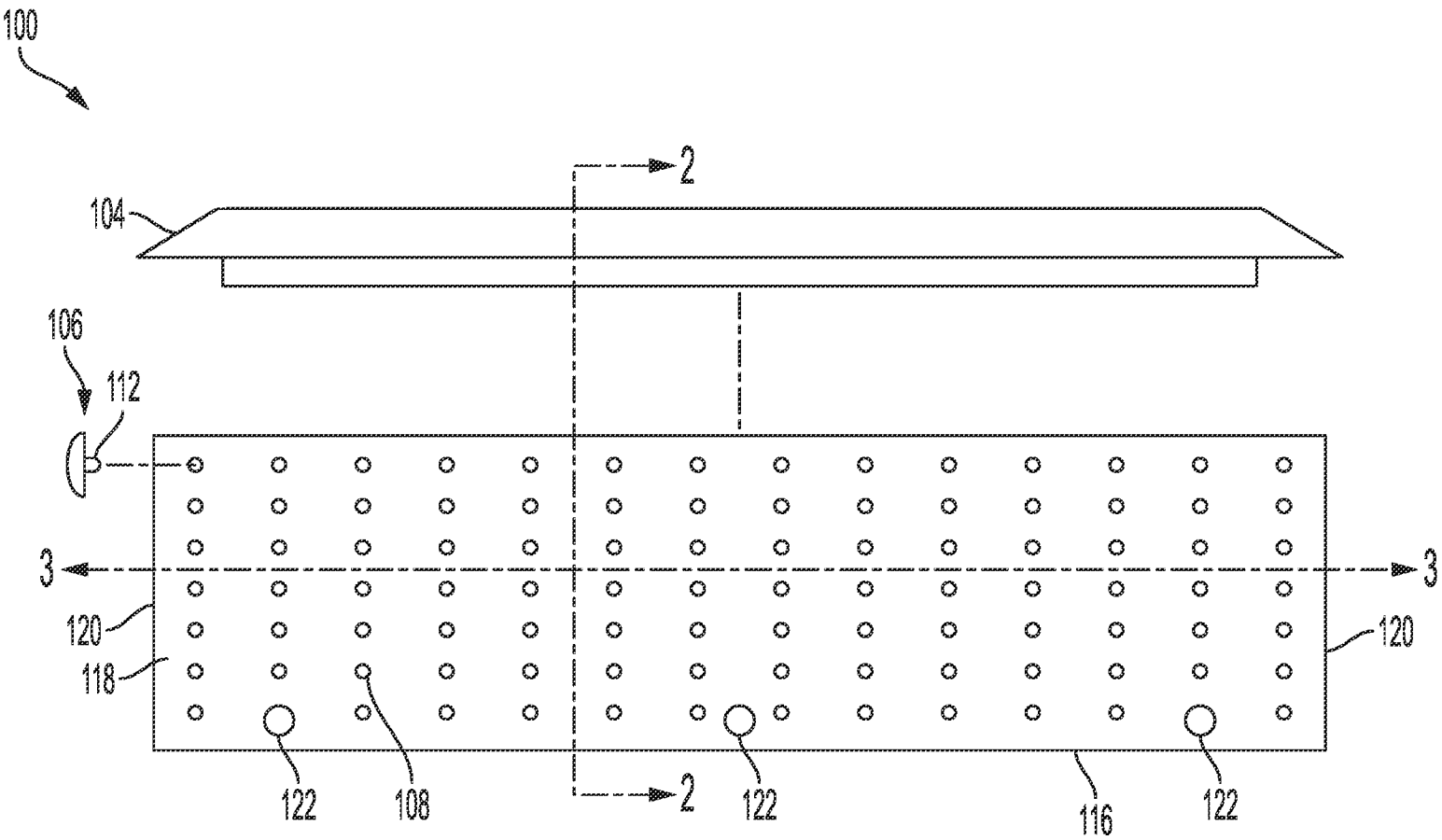
FIG. 1 is a side perspective view of a mycelium composite burial container without pegs inserted according to an embodiment of the present invention.
Figure 2:
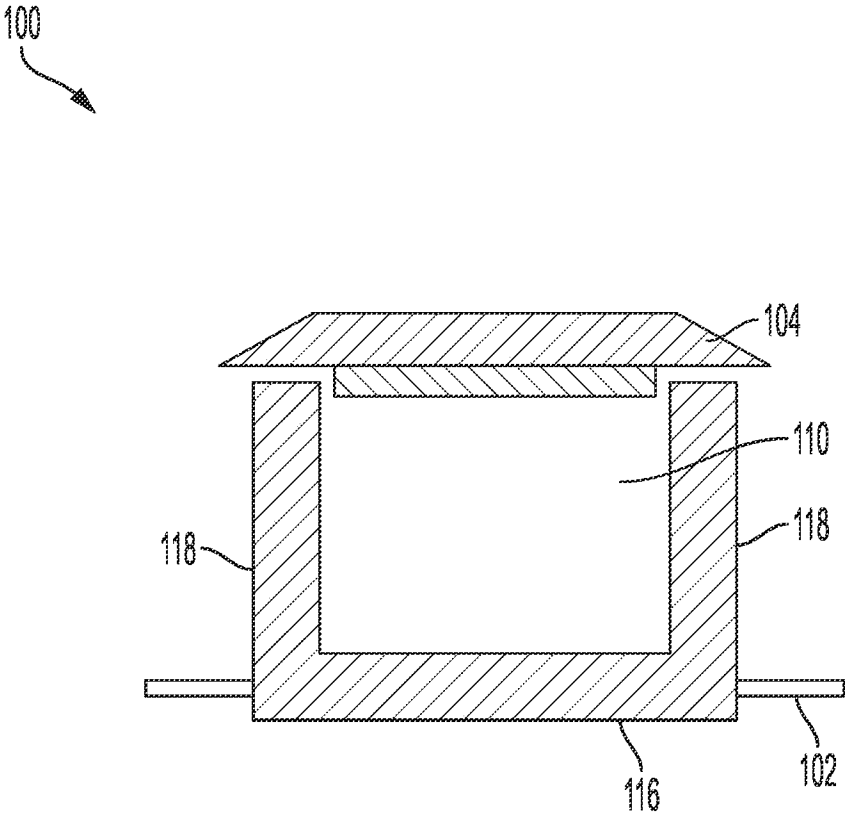
FIG. 2 shows a section of a mycelium composite container 100, taken on the line 2-2 of FIG. 1 looking in the direction of the arrows.
Figure 3:
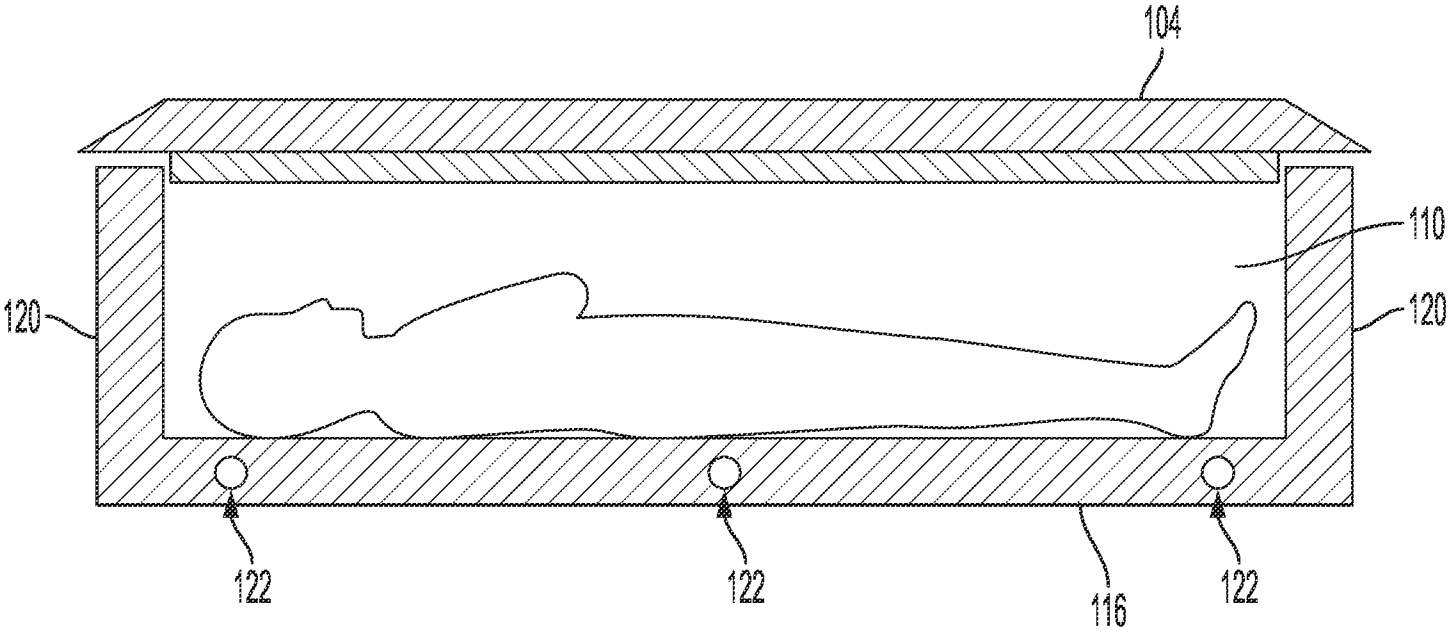
FIG. 3 shows a section of a mycelium composite container 100, taken on the line 3-3 of FIGURE looking in the direction of the arrows.
Figure 5:
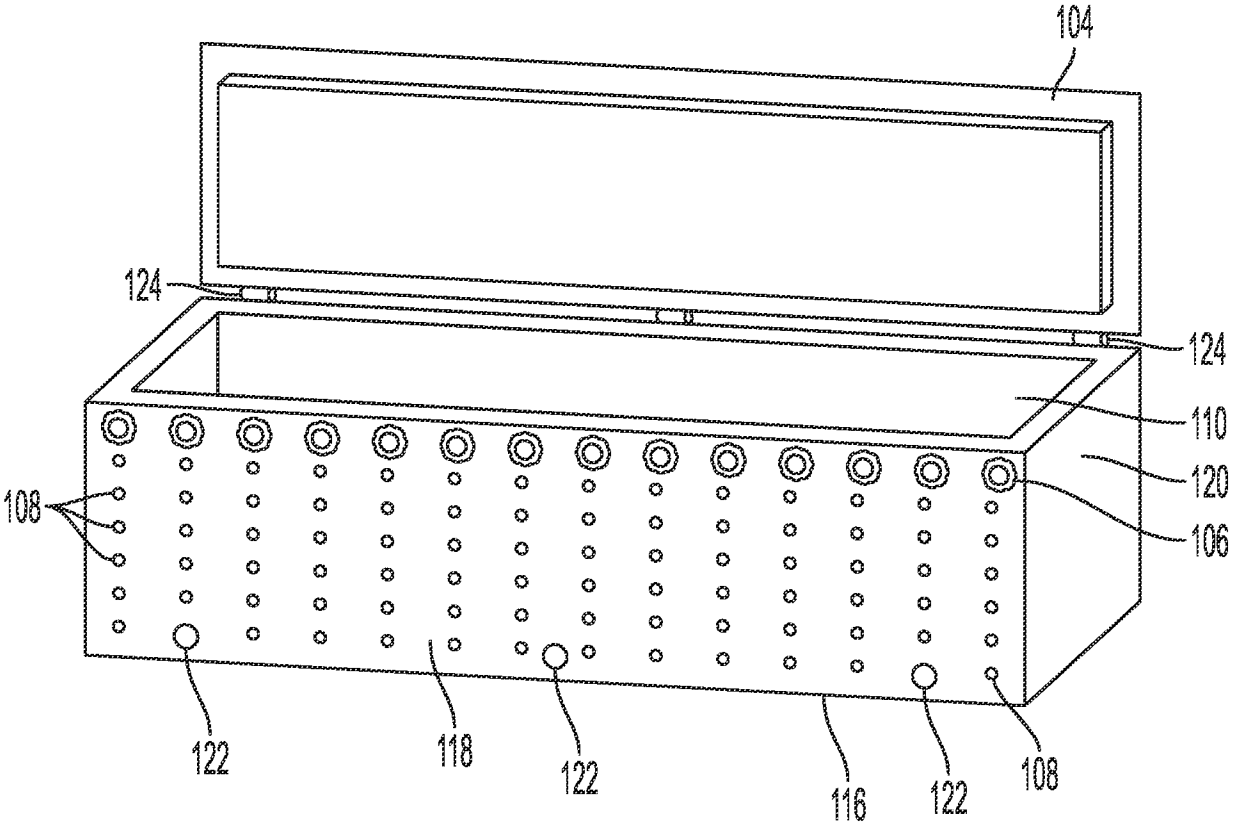
FIG. 5 is a side perspective view of a mycelium composite burial container with some pegs inserted and with hinges according to an embodiment of the present invention.
Figure 4:
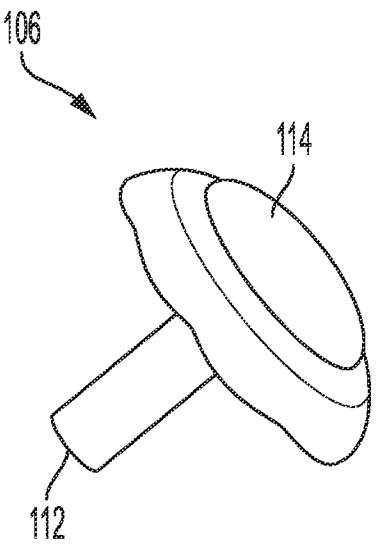
FIG. 4 is a side perspective view of a peg according to an embodiment of the present invention.

Referring now to the figures where similar reference characters denote similar elements throughout the figures, FIGS. 1 through 5 show a mycelium composite burial container 100 for use in green and natural burials having an outer surface, a lid 104, an opening 110, and one or more pegs 106. The outer surface preferably made completely of mycelium composite but must be made at least in part of mycelium composite. Where the outer surface is made in part of mycelium composite, any other materials used must be biodegradable. For example, other materials may include agricultural cuttings such as straw, corn, or wheat stalks, cardboard or other paper, in conjunction with mycelium composite. The outer surface featuring a plurality of equally spaced apart grooves 108 on at least a majority of the outer surface. The lid 104 preferably made completely of mycelium composite but must be made at least in part of mycelium composite, wherein the lid 104 is configured to completely seal the opening 110. Where the lid 104 is made in part of mycelium composite, any other materials used must be biodegradable. In an embodiment of the present invention the lid 104 is attached to the container 100 at the opening 110 by one or more hinges 124. The hinges 124 configured to cause the lid 104 to seal and unseal the opening 110. The hinges made from mycelium composite or another biodegradable material. The one or more pegs 106 preferably made completely of mycelium composite but must be made at least in part of mycelium composite. Where the one or more pegs 106 are made in part of mycelium composite, any other materials used must be biodegradable. Each peg 106 having a first end 112 and a second end 114 distal from the first end. The first end 112 configured for insertion into any of the plurality of grooves 108, the second end 114 including of a decorative element.

The outer surface comprises a bottom wall 116, two long parallel side walls 118 that are of equal length and width extending upward from the bottom wall 116, two short parallel sides walls 120 that are of equal length and width extending upward from the bottom wall 116, the long side walls 118 perpendicular to the short walls 120 and the long walls 118 longer than the short walls 120. In a preferred embodiment, the bottom wall, long walls, and short walls are between 5 to 7 inches thick, inclusive, with 5 inches being the ideal thickness. The bottom wall 116 having two or more tunnels 122 extending horizontally and widthwise through the bottom wall 116. The two or more tunnels 122 each configured to receive rods 102 for carrying and lowering the container into the grave pit.

In a preferred embodiment, the lid 104 is a friction lid measuring approximately 7 to 10 inches deep, inclusive, with 8 inches being the ideal depth. The width and length of the lid 104 is 2 inches more than the external width and length of the outer surface of the container 100. The external width of the outer surface is a minimum of 33 inches and the external length of the outer surface is a minimum of 84 inches. The external height of the outer surface preferably measuring 16 to 24 inches, inclusive.

The invention preferably using local indigenous mycelium samples, or common non-competitive mycelium strains cast in silicone or upcycled plastic mold. The mycelium composite is made of a mixture of mycelium spores and any nutrient material capable of being digested by the mycelium. Nutrient material may include any carbon-based material such as plant stems, straw, hemp hurds, corn husks or other non-leafy fibers of a plant. The nutrient material is pasteurized before use to remove any bacteria present. It is then dried and combined with mycelium spores sufficient to digest the nutrient material. The mycelium composite is fed with water, mixed, and left for 5 to 10 days or until the nutrient material is completely digested. The mycelium composite is then placed in a clear mold until it is dried. The mold should be clear in order to allow light to reach the mycelium composite to facilitate digestion of the nutrient material. The mold may be made of plastic, silicone, or any clear material commonly used to make molds. The mold configured to produce the desired shape of the container. The container is then removed from the mold and then allowed to air dry for another few days to ensure complete structural solidity.

This disclosure is not intended to limit the invention to the particular assembly disclosed, but, to the contrary, the intention is to cover all modifications, equivalents, and alternatives falling within the scope of the claims.

What is claimed is:

1. A container for holding a deceased or their remains comprising:

a) an outer surface made at least in part of mycelium composite, wherein the outer surface comprises a plurality of equally spaced apart grooves on at least a majority of the outer surface;

b) an opening for receiving the deceased or their remains;

c) a lid made at least in part of mycelium composite, wherein the lid is configured to completely seal the opening; and d) one or more pegs made at least in part of mycelium composite, each peg comprising a first end and a second end distal from the first end, the first end configured for insertion into any of the plurality of grooves, the second end consisting essentially of a decorative element.

2. The container of claim 1, wherein the decorative element is made of mycelium composite.

3. The container of claim 1, wherein the lid is partially attached to the container at the opening by one or more hinges.

4. The container of claim 1, wherein the outer surface comprises a bottom wall, two long parallel side walls that are equal in length and width extending upward from the bottom wall, two short parallel sides walls that are equal in length and width extending upward from the bottom wall, the long side walls perpendicular to the short side walls and the long side walls longer than the short side walls.

5. The container of claim 4 wherein the bottom wall further comprises two or more tunnels, each tunnel for receiving a rod, the rods for holding the container and lowering the container into a grave pit.

* * * * *